US009378454B2

(12) United States Patent
Marquez

(10) Patent No.: US 9,378,454 B2
(45) Date of Patent: Jun. 28, 2016

(54) CUP COUNTER

(71) Applicant: Joseph Marquez, Rossmoor, CA (US)

(72) Inventor: Joseph Marquez, Rossmoor, CA (US)

(73) Assignee: Joseph G. Marquez, Rossmoor, CA (US)

( * ) Notice: Subject to any disclaimer, the term of this patent is extended or adjusted under 35 U.S.C. 154(b) by 337 days.

(21) Appl. No.: 14/057,303

(22) Filed: Oct. 18, 2013

(65) Prior Publication Data

US 2015/0023462 A1 Jan. 22, 2015

Related U.S. Application Data

(60) Provisional application No. 61/857,118, filed on Jul. 22, 2013.

(51) Int. Cl.
*G06M 9/00* (2006.01)
*G06M 3/06* (2006.01)

(52) U.S. Cl.
CPC .. *G06M 9/00* (2013.01); *G06M 3/06* (2013.01)

(58) Field of Classification Search
CPC ..... G06M 9/00
See application file for complete search history.

(56) References Cited

U.S. PATENT DOCUMENTS

| | | | | |
|---|---|---|---|---|
| 3,965,340 | A | 6/1976 | Renner et al. | |
| 4,156,190 | A | 5/1979 | Chittenden et al. | |
| 4,229,646 | A | 10/1980 | Burkhardt et al. | |
| 4,229,647 | A | 10/1980 | Burkhardt | |
| 4,436,990 | A * | 3/1984 | Saccucci | G06M 9/00 235/1 R |
| 7,045,765 | B2 | 5/2006 | Auboussier et al. | |
| 7,224,762 | B2 | 5/2007 | Koger | |
| 8,180,015 | B2 * | 5/2012 | Nalle, III | G06M 1/06 221/182 |
| 2002/0186807 | A1 | 12/2002 | Kozak | |

FOREIGN PATENT DOCUMENTS

| | | | |
|---|---|---|---|
| EP | 0371881 | A2 | 6/1990 |

* cited by examiner

*Primary Examiner* — Hai L Nguyen
(74) *Attorney, Agent, or Firm* — James C. Yang

(57) ABSTRACT

A handheld cup counter is disclosed. The cup counter may have a mechanical or optical sensor used to count the number of brim portions within a stack of cups. In order to properly position the optical or mechanical sensor, the sensor is disposed in relation to a ridge plate that helps the user to properly align the sensor to the stack of cups so that the sensor may accurately sense the number of brim portions within the stack of cups. The cup sensor may also have additional calculator functionality that works in conjunction with the sensed number of cups in order to more efficiently add and subtract the sensed number of cups of a plurality of stack of cups.

14 Claims, 3 Drawing Sheets

CUP COUNTER

CROSS-REFERENCE TO RELATED APPLICATIONS

This application claims the benefits of U.S. Prov. App. Ser. No. 61/857,118, filed on Jul. 22, 2013, the entire contents of which is expressly incorporated herein by reference.

STATEMENT RE: FEDERALLY SPONSORED RESEARCH/DEVELOPMENT

Not Applicable

BACKGROUND

The various embodiments and aspects described herein are directed to a cup counter for counting a stack of cups.

Restaurants and movie theaters count cups in order to provide a check and balance as to whether their employees are stealing money or giving away free product to their friends and family. Accordingly, it is important to accurately and efficiently count the number of cups at a location. Unfortunately, the process of counting cups is inaccurate and tedious.

Accordingly, there is a need in the art for a device and method for counting cups in an accurate and efficient manner.

BRIEF SUMMARY

A cup counter for counting a stack of cups is shown. The cup counter may have a body sized and configured to be held in one hand so that the user can operate the cup counter with one hand while steadying the stack of cups with a second hand. The cup counter may have a mechanical or optical sensor for sensing brim portions of the stack of cups. The sensor is positioned on a ridge plate that helps the user to properly position the sensor to the stack of cups and ensure that the sensor remains properly positioned as the cup counter is swiped along the length of the stack of cups.

More particularly, a portable counter for counting cups stacked upon each other is disclosed. The counter may comprise a handle, a means for sensing a brim portion of each of the cups stacked upon each other, a processor, memory and a battery. The handle is used to traverse the counter along the stacked cups. The means for sensing may be a mechanical sensor or an optical sensor. The display is used to show a number representative of the sensed brim portions of the cups stacked upon each other. The processor and memory are in communication with the means for sensing and the display for processing and storing data related to the sensed brim portions of the cups stacked upon each other. The battery is in communication with the processor and memory for powering the processor and memory.

The means for sensing may be a mechanical clicker. Alternatively, the means for sensing may be a proximity sensor. As a further alternative, the means for sensing may be an optical sensor.

The counter may further comprise a ridge plate sufficiently long to contact at least two brim portions of adjacent cups stacked upon each other. The ridge plate may be flat in a direction of travel and convex transverse to the direction of travel of the counter.

The counter may further comprise a plurality of buttons for activating and deactivating the means for sensing, storing and/or recalling first and second counted cups into respective first memory and second memory.

The means for sensing may include a protrusion extending out of the ridge plate. The protrusion may be biased outward and depressable one time to count one cup. The protrusion may have opposed wedge surfaces so that the counter is traversable bi-directionally.

In another aspect, a method of counting cups stacked upon each other is disclosed. The method may comprise the steps of positioning a means for sensing of a cup counter prior to a brim portion of a first cup of the cups stacked upon each other; and traversing the means for sensing along a length of the cups stacked upon each other from the first cup to the last cup.

The method may further comprise a step of contacting a ridge plate against brim portions of at least the first two cups stacked upon each other.

In the method, the traversing step is accomplished while maintaining contact between the ridge plate and the brim portions of at least two adjacent cups.

The method may further comprise the step of depressing a protrusion of the means for sensing with each of the brim portions of the cups stacked upon each other.

The method may further comprise the steps of positioning the means for sensing of the cup counter prior to the brim portion of the first cup of the cups of a first size stacked upon each other; traversing the means for sensing along a length of the cups of the first size stacked upon each other from the first cup to the last cup; pressing a first memory button on the cup counter to store a number of counted cups of the first size; positioning the means for sensing of the cup counter prior to the brim portion of the first cup of the cups of a second size stacked upon each other; traversing the means for sensing along a length of the cups of the second size stacked upon each other from the first cup to the last cup; and pressing a second memory button on the cup counter to store a number of counted cups of the second size.

The method may further comprise the steps of positioning the means for sensing of the cup counter prior to the brim portion of the first cup of the cups of the first size of a second stack; traversing the means for sensing along the length of the cups of the first size stacked upon each other from the first cup to the last cup of the second stack; and pressing the first memory button on the cup counter to add a number of counted cups of the first size of the second stack to the number of counted cups of the first size of the first stack.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 5:
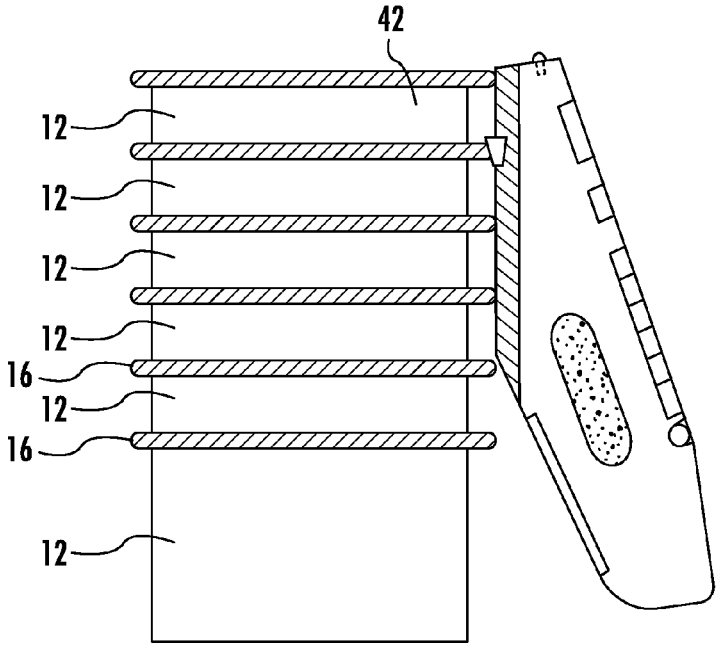
FIG. 5 is a side view of the cup counter illustrating a proper positioning of the cup counter to a stack of cups.
Figure 6:
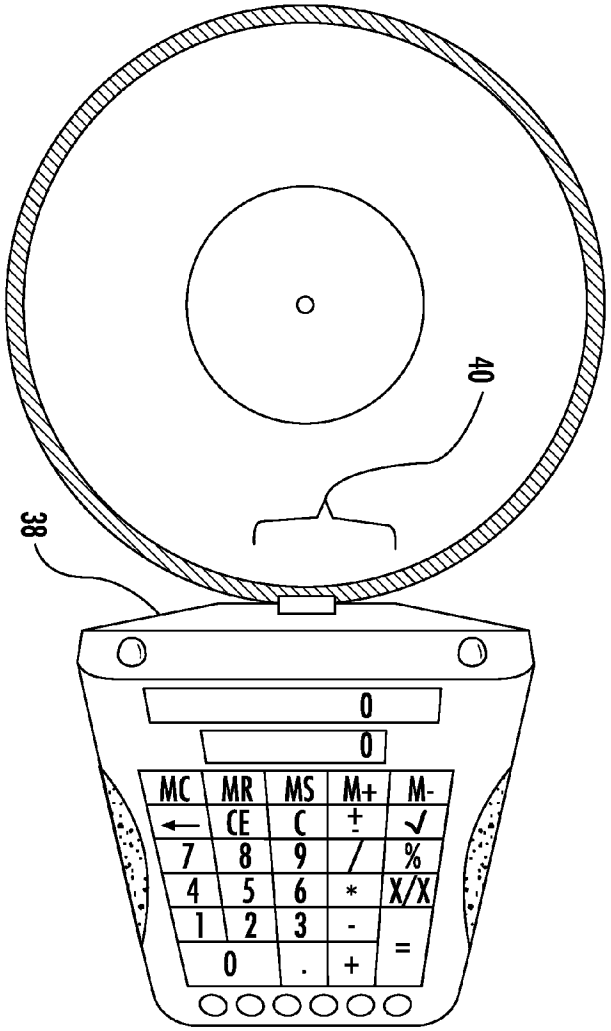
FIG. 6 is a top view of the cup counter and stack of cups shown in FIG. 5.

Referring now to the drawings, a cup counter 10 is shown and described which permits a user to efficiently and accurately count a plurality of cups 12 that are stacked upon each other (see FIG. 5). With the cups 12 stacked upon each other, the user may position the sensor 14 of the cup counter 10 at the bottom or the top of the stack of cups 12 and run the sensor 14 along the brim portions 16 of the stack of cups 12 to efficiently and accurately count the number of cups 12 in the stack of cups 12. The sensor 14 of the cup counter 10 counts the number of brim portions 16 (i.e., cups 12) and displays the number of brim portions 16 on a display 18. The cup counter 10 may also have other functionalities, such as memory functions so that the user may count different size cups 12 in any order and a calculator function.

Figure 1:
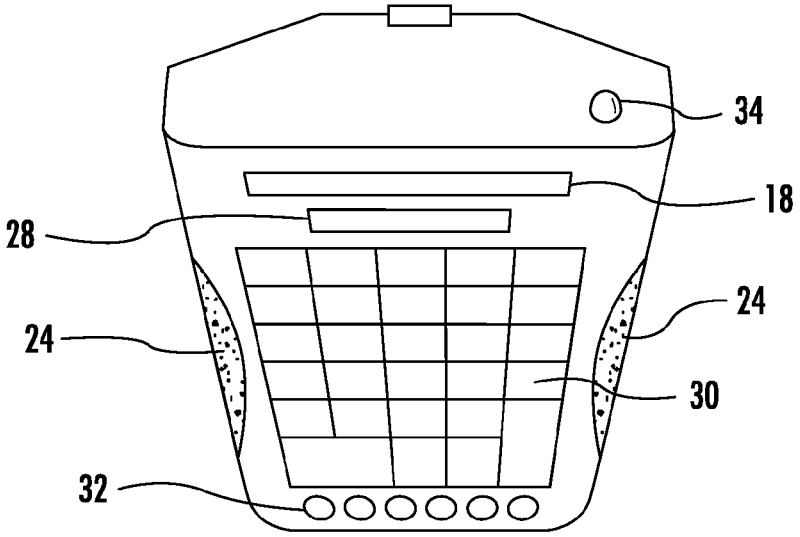
FIG. 1 is a front view of a cup counter.
Figure 2:
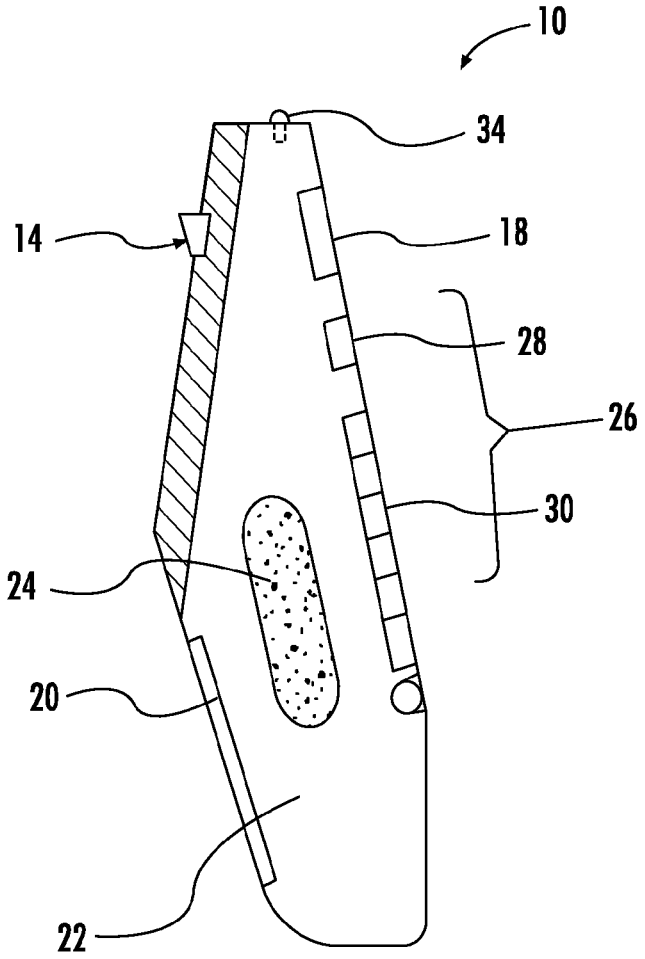
FIG. 2 is a side view of the cup counter, shown in FIG. 1.

More particularly, the cup counter 10 is shown in FIGS. 1 and 2. The cup counter 10 is portable so that the user can take the cup counter 10 from location to location to count cups 12 at different locations. Also, the user is not limited to one area once at the location. To this end, the cup counter 10 may be battery-operated so that the user is not limited to a certain location or to a certain range of an electrical outlet at the location. The battery pack may be accessed from a back panel 20 that can be slid off of the body 22 to replace the battery of the cup counter 10. Also, the battery may be rechargeable.

The body 22 of the cup counter 10 may have grip pads 24 on opposed sides of the body 22 so that the user can easily grip and operate the cup counter 10 with one hand to count the stack of cups 12. The thumb and index finger may grip the grip pads 24 to hold the cup counter 10. The body 22 of the cup counter 10 may be sized and configured to fit within one hand so that the user can operate the cup counter 10 with one hand while steadying the stack of cups 12 with the other hand.

Figure 3:
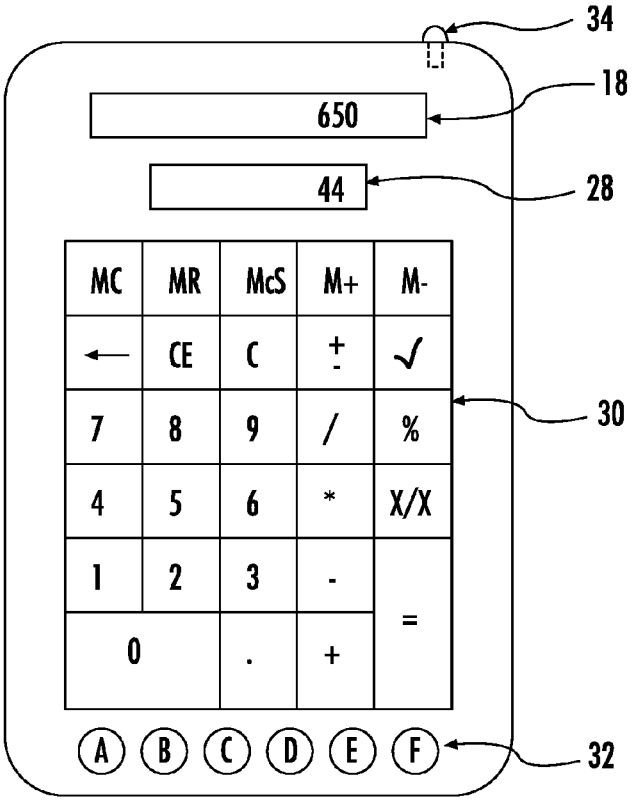
FIG. 3 is an enlarged view of a keypad and displays of the cup counter shown in FIG. 1.

The front side of the cup counter 10 may have the display 18 and a calculator user interface 26 which includes its own display 28 and a calculator control panel such as a keypad 30. The keypad 30 may include numbers and math functions such as addition, subtraction, multiplication and division. During use of the cup counter 10, the calculator may be used to calculate the number of cups 12. The front side of the cup counter 10 may additionally have one or more memory buttons 32. To use the memory buttons 32, the number of sensed cups 12 is shown on display 18 which may be stored into memory cells by depressing a corresponding memory button 32. Display 28 is used in conjunction with the calculator. FIG. 3 illustrates the display 18 for displaying the number of cups 12 counted by the cup counter 10. The display 28 used in conjunction with the keypad 30 and the memory buttons 32.

The cup counter 10 may be powered on or off by way of power button 34 which may be located at the top of the body 22 of the cup counter 10.

Figure 4:
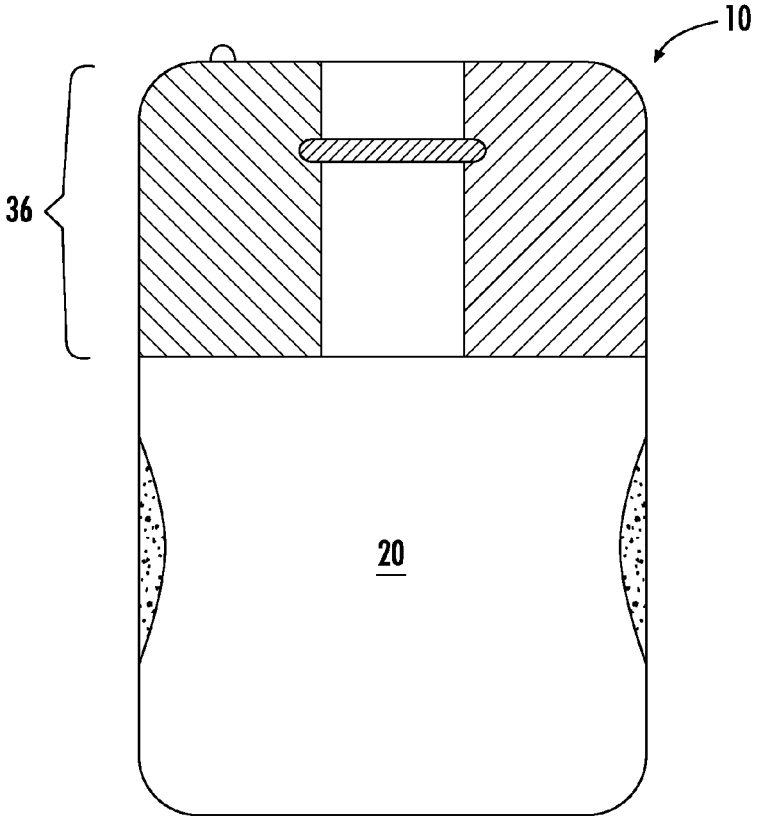
FIG. 4 is a rear view of the cup counter shown in FIG. 1.

Referring now to FIG. 4, the backside of the cup counter 10 may have a ridge plate 36. The ridge plate 36 has a flat middle portion 40 and generally convex exterior surface 38. The flat middle portion 40 may be placed against the stack of cups 12 so that the flat middle portion 40 contacts at least two of the brim portions 16 of adjacent cups 12. In this position, the sensor 42 should be visible to the user when the sensor 42 is disposed between adjacent brim portions 16 of adjacent cups 12. If the user is unable to see the sensor 42, then the cup counter 10 should be adjusted until the user can see the sensor 42 between adjacent brim portions 16 of adjacent cups 12. By doing this, the user is able to physically determine whether the cup counter 10 is in proper position to count the stack of cups 12.

The sensor 42 may be a mechanical counter that sends an electrical signal to a processor. As the mechanical counter passes over each of the brim portions 16, the brim portion 16 deflects a protrusion of the mechanical counter. The protrusion extends and is normally biased past the flat middle portion 40. After the mechanical counter traverses over the brim portion 16 and the protrusion is disposed between adjacent brim portions 16, the mechanical counter is biased outward again. For each cycle, the mechanical counter sends the electrical signal to the processor to indicate that one cup has been counted. The electrical signal may be sent when the protrusion is depressed or traversed outward. As the user traverses up or down the stack of cups 12, the brim portions 16 deflect the protrusion of the mechanical counter inward and the protrusion is extended back outward. For each cycle, a single cup is counted. The biasing of the protrusion may be accomplished with a spring. The spring pushes the protrusion back outward as the protrusion passes into the gap between the brim portions 16.

The protrusion may have a wedge-shaped configuration so that the brim portion 16 can ride along the angled surface of the protrusion to push the protrusion inward in a gradual manner. The angled surface may be on opposed upper and lower sides of the protrusion so that the user may run the cup counter 10 up or down the stack of cups 12, as desired.

The sensor 42 may alternatively be an electronic sensor such as a proximity sensor. The proximity sensor may be calibrated to sense the brim portions 16 and sense an absence of material when the proximity sensor is disposed between the brim portions 16. The proximity sensor may send an electronic signal to the processor each time that the proximity sensor traverses over a brim portion 16.

During use, the user may utilize the memory buttons 32 to count different size cups 12 in different order. By way of example and not limitation, the user may be presented with a plurality of stacks of cups 12 for counting. The stack of cups 12 may be different sizes such as small, medium and large. It may be inconvenient to count all of the small stacks of cups 12 at once. Rather, it may be more convenient to count each stack in the order presented instead of by size. The cup counter 10 allows the user to count the stack of cups 12 in the order presented. The user may be presented with a stack of small cups 12, then a stack of medium cups 12 and then a stack of small cups 12. The cup counter 10 allows the user to retrieve the number of cups 12 in the first stack of small cups 12 and allows the user to add on to such number when counting the third stack of small cups 12.

In particular, the user may carry the counter 10 into a store location (e.g., movie theater, restaurant or other location that needs to have its cups 12 counted for inventory purposes). The cup counter 10 which may be battery operated is turned on by pressing the power button 34 at the top of the cup counter 10. In operation, the user positions the sensor 42 of the cup counter 10 below the lowest brim portion 16 or above the highest brim portion 16 within a first stack of cups 12. Additionally, the flat middle portion 40 of the ridge plate 36 of the cup counter 10 is positioned to contact at least two brim portions 16 within the stack of cups 12 to be counted. Additionally, the user should be able to see the sensor 42 from the side of the cup counter 10. The ridge plate 36 extends convexly beyond the flat middle portion 40 so as to not block the user's view of the sensor 42 from the side view.

If the sensor 42 is placed below the lowest brim portion 16 of the stack of cups 12, then the user runs the sensor 42 up until the sensor 42 passes the uppermost brim portion 16 of the stacks of cups 12. The display 18 displays the number of brim portions 16 sensed by the sensor 42. If the next stack of cups 12 is of the same size as the previously counted stack of cups 12, then the user need only repeat the process above to count the number of cups 12 in the second stack of cups 12. The sensed number of cups 12 of the second stack is automatically added to the sensed number of cups 12 of the first stack. However, if the second stack of cups 12 is of a different size compared to the first stack of cups 12 then the number of sensed cups 12 of the first stack is placed into memory by depressing one of the memory buttons 32. Upon depressing one of the memory buttons 32, the number of sensed cups 12 of the first stack is placed into such memory location. The display 18 is reset for counting of the number of cups 12 in the second stack. The user then may proceed to count the number of cups 12 in the second stack. If the third stack of cups 12 is the same size as the second stack of cups 12, then the user may continue to count the number of cups 12 in the second stack. However, if the third stack of cups 12 is of a different size or is the same size as the first stack of cups 12, the user may store the number of sensed cups 12 of the second stack in a new memory location by depressing a different memory button 32. If the third stack of cups 12 is the same size as the first stack, then the user may depress the first memory button 32 to recall the number of sensed cups 12 in the first stack. This number may be displayed in display 28. The user then counts the number of cups 12 in the third stack wherein the sensed number of cups 12 is displayed in display 18. To add the number of sensed cups 12 shown in display 18 to the number of sensed cups 12 shown in display 28, the user presses the addition sign on the keypad 30.

If a user counts a stack of cups 12 and adds the number of sensed cups 12 to the wrong memory location, then the user can simply subtract the number of cups 12 by recounting the stack of cups 12 and pressing the subtraction sign.

The above description is given by way of example, and not limitation. Given the above disclosure, one skilled in the art could devise variations that are within the scope and spirit of the invention disclosed herein, including various ways of configuring the body of the cup counter 10. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A portable counter for counting cups stacked upon each other, the counter comprising:

a handle for traversing the counter along the stacked cups, a means for sensing a brim portion of each of the cups stacked upon each other;

a display for indicating a number representative of the sensed brim portions of the cups stacked upon each other;

a processor and memory in communication with the means for sensing and the display for processing and storing data related to the sensed brim portions of the cups stacked upon each other;

a battery in communication with the processor and memory for powering the processor and memory.

2. The counter of claim 1 wherein the means for sensing is a mechanical clicker.

3. The counter of claim 1 wherein the means for sensing is a proximity sensor.

4. The counter of claim 1 wherein the means for sensing is an optical sensor.

5. The counter of claim 1 further comprising a ridge plate sufficiently long to contact at least two brim portions of adjacent cups stacked upon each other.

6. The counter of claim 5 wherein the ridge plate is flat in a direction of travel of the counter and convex transverse to the direction of travel of the counter.

7. The counter of claim 1 farther comprising a plurality of buttons for activating and deactivating the means for sensing, storing first and second counted cups into respective first memory and second memory.

8. The counter of claim 5 wherein the means for sensing is a protrusion extending out of the ridge plate, the protrusion being biased outward and depressable one time to count one cup.

9. The counter of claim wherein the protrusion has opposed wedge surfaces so that the counter is traversable bi-directionally.

10. A method of counting cups, stacked upon each other, the method comprising the steps of:

positioning a means for sensing of a cup counter prior to a brim portion of a first cup of the cups stacked upon each other; and traversing the means for sensing along a length of the cups stacked upon each other from the first cup to the last cup; and contacting a ridge plate against brim portions of at least the first two cup stacked upon each other.

11. The method of claim 10 wherein the traversing step is accomplished while maintaining contact between the ridge plate and the brim portions of at least two adjacent cups.

12. A method of counting cups stacked upon each other, the method comprising the steps of:

positioning a means for sensing of a cup counter prior to a brim portion of a first cup of the cups stacked upon each other; and traversing the means for sensing along a length of the cups stacked upon each other from the first cup to the last cup; and depressing a protrusion of the means for sensing each of the brim portions of the cups stacked upon each other.

13. A method of counting cups stacked upon each other, the method comprising the steps of:

positioning a means for sensing of a cup counter prior to a brim portion of a first cup of the cups stacked upon each other; and traversing the means for sensing along a length of the cups stacked upon each other from the first cup to the last cup;

positioning the means for sensing of the cup counter prior to the brim portion of the first cup of the cups of a first size stacked upon each other;

traversing the means for sensing, along a length of the cups of the first size stacked upon each other from the first cup to the last cup;

pressing a first memory button on the cup counter to store a number of counted cups of the first size;

positioning the means for sensing of the cup counter prior to the brim portion of the first cup of the cups of a second size stacked upon each other;

traversing the means for sensing along a length of the cups of the second size stacked upon each other from the first cup to the last cup;

pressing a second memory button on the cup counter to store a number of counted cups of the second size.

14. The method of claim 13 further comprising the steps of:

positioning the means for sensing of the cup counter prior to the brim portion of the first cup of the cups of the first size of a second stack;

traversing the means for sensing along the length of the cups of the first size stacked upon each other from the first cup to the last cup of the second stack; and pressing the first memory button on the cup counter to add a number of counted cups of the first size of the second stack to the number of counted cups of the first size of the first stack.

* * * * *